US006915091B2

(12) United States Patent
Matsumaru et al.

(10) Patent No.: US 6,915,091 B2
(45) Date of Patent: Jul. 5, 2005

(54) DEVELOPING APPARATUS

(75) Inventors: Naoki Matsumaru, Shizuoka (JP); Yoshiyuki Batori, Shizuoka (JP); Hiroki Ogino, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/687,735

(22) Filed: Oct. 20, 2003

(65) Prior Publication Data

US 2004/0081480 A1 Apr. 29, 2004

(30) Foreign Application Priority Data

Oct. 22, 2002 (JP) ..... 2002-306607

(51) Int. Cl.[7] ..... G03G 15/08

(52) U.S. Cl. ..... 399/104; 399/99; 399/103; 399/273; 399/283

(58) Field of Search ..... 399/103, 104, 399/98, 99, 265, 267, 279, 286, 111, 119, 273, 283

(56) References Cited

U.S. PATENT DOCUMENTS

| | | | | |
|---|---|---|---|---|
| 5,790,923 A | | 8/1998 | Oguma et al. | 399/106 |
| 6,205,304 B1 | | 3/2001 | Kawaguchi | 399/103 |
| 6,266,500 B1 | * | 7/2001 | Numagami et al. | 399/104 |
| 6,606,469 B2 | | 8/2003 | Kikuchi et al. | 399/104 |
| 2002/0110383 A1 | | 8/2002 | Kikuchi et al. | 399/103 |
| 2002/0172526 A1 | * | 11/2002 | Miyabe et al. | 399/104 |

FOREIGN PATENT DOCUMENTS

| | | | |
|---|---|---|---|
| JP | 9-218578 | | 8/1997 |
| JP | 9-325617 | | 12/1997 |
| JP | 2000-131926 | | 5/2000 |
| JP | 2001-350344 | | 12/2001 |
| JP | 2002-236419 | | 8/2002 |
| JP | 2002-268515 | | 9/2002 |
| JP | 2003-015413 A | * | 1/2003 |

* cited by examiner

*Primary Examiner*—Sophia S. Chen
(74) *Attorney, Agent, or Firm*—Fitzpatrick, Cella, Harper & Scinto

(57) ABSTRACT

The present invention provides a developing apparatus comprising a developer bearing member for bearing developer, a spacer provided on a surface at an end portion of the developer bearing member along a longitudinal direction, for maintaining a constant gap between the developer bearing member and an image bearing member for supplying the developer from the developer bearing member, a seal member for regulating leakage of the developer toward the end portion of the developer bearing member along the longitudinal direction, and a developer scraping member provided at a portion overlapping with the seal member along the longitudinal direction of the developer bearing member, contacting the developer bearing member, and wherein the developer bearing member contacts a surface of the spacer.

8 Claims, 6 Drawing Sheets

DEVELOPING APPARATUS

BACKGROUND OF THE INVENTION

1. Field of the Invention

The present invention relates to a developing apparatus mounted to an image forming apparatus such as a copier, a printer and the like and, more particularly, it relates to a developing apparatus in which a gap is provided between an image bearing member and a developing sleeve.

2. Related Background Art

Conventionally, in electro-photographic image forming apparatuses utilizing an electro-photographic image forming process, a process cartridge system in which an electro-photographic photosensitive member (referred to as "photosensitive drum" hereinafter) and process means acting on the electro-photographic photosensitive member are integrated as a cartridge which can be mounted and dismounted with respect to the image forming apparatus has been adopted. According to this process cartridge, since maintenance of the image forming apparatus can be performed by the user himself without any service man or expert, operability can be enhanced considerably. Thus, the process cartridge system has widely been used in the image forming apparatus. Among the image forming apparatuses in which magnetic toner is used in the process cartridge, there has been adopted means in which ferromagnetic seal members (referred to as "magnetic seals" hereinafter) are disposed at longitudinal end portions of a developer bearing member (referred to as "developing sleeve" hereinafter) constituting a part of a developing apparatus in a non-contacting relationship to the developing sleeve so that toner is held by magnetic forces of the magnetic seals to prevent the toner from leaking outside the developing apparatus.

Further, for example, as disclosed in Japanese Patent Application Laid-open No. 9-218578, a developer scraping member (referred to as "scraper" hereinafter) having a function for removing or scraping off the toner from a surface of the developing sleeve before the toner held between the developing sleeve and the magnetic seals reaches a developing portion between the photosensitive drum and the developing sleeve and, at the same time, for gathering the removed toner toward a developing area (inside) has been used together with the magnetic seals.

SUMMARY OF THE INVENTION

The present invention aims to further improve the prior art, and an object of the present invention is to provide a developing apparatus in which high quality images can be obtained stably for a long term.

Another object of the present invention is to provide a developing apparatus comprising a developer bearing member for bearing developer, a spacer provided on a surface at an end portion of the developer bearing member along a longitudinal direction and adapted to maintain a constant gap between an image bearing member for supplying the developer from the developer bearing member and the developer bearing member, a seal member for regulating leakage of the developer toward the end portion of the developer bearing member along the longitudinal direction, and a developer scraping member provided at a portion overlapping with the seal member along the longitudinal direction of the developer bearing member, contacting the developer bearing member, and wherein the developer bearing member also contacts with a surface of the spacer.

The other objects of the present invention will be apparent from the following detailed explanation made with reference to the accompanying drawings.

DESCRIPTION OF THE PREFERRED EMBODIMENTS

Now, embodiments of the present invention will be explained with reference to the accompanying drawings.

(Entire Construction)

Figure 1:
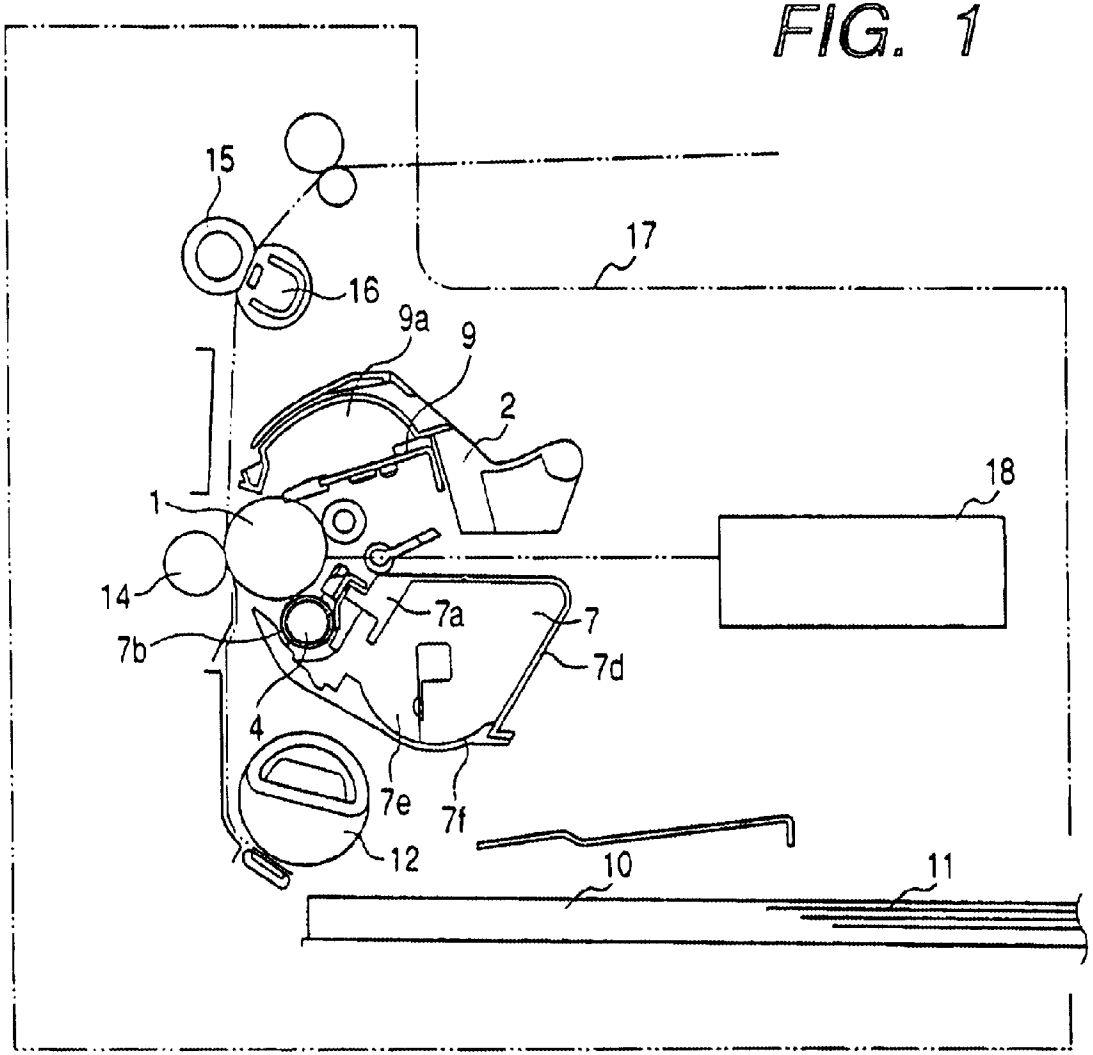
FIG. 1 is a sectional view a main body of an image forming apparatus.

FIG. 1 is a sectional view showing a condition that a process cartridge mounting thereon a developing apparatus according to the present invention is mounted to a main body of an image forming apparatus.

The image forming apparatus serves to form an image on a recording medium by an electro-photographic image forming process. As shown in FIG. 1, a toner image is formed on a drum-shaped electro-photographic photosensitive member (photosensitive drum) 1 as an image bearing member. In synchronism with formation of the toner image, a recording medium 11 set on a sheet feeding tray 10 is conveyed by convey means comprising a pick-up roller 12, a convey roller and the like.

Then, the toner image formed on the photosensitive drum 1 provided in a process cartridge A is transferred onto the recording medium 11 by applying voltage to a transferring roller 14 as transferring means. Thereafter, the recording medium 11 to which the toner image was transferred is conveyed to fixing means while being guided by a guide plate. The fixing means is constituted by a fixing roller 16 including therein a heater and a pressurizing roller 15 for urging the recording medium 11 against the fixing roller 16 to convey the recording medium and serving to fix the toner image to the recording medium 11 by applying heat and pressure to the recording medium 11. The recording medium 11 to which the toner image was fixed is conveyed by discharge rollers to be discharged onto a discharge portion 17.

(Process Cartridge)

Figure 2:
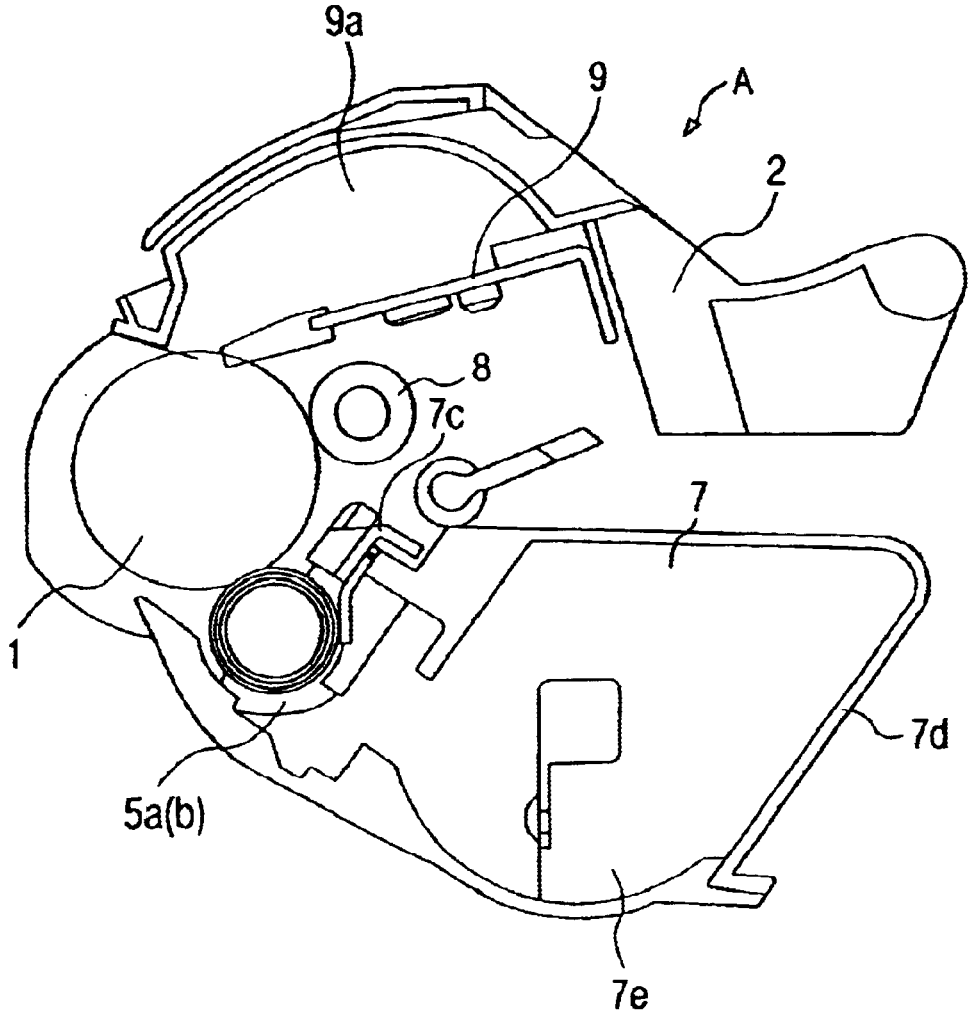
FIG. 2 is a sectional view of a process cartridge A.

Next, the process cartridge A will be explained with reference to FIG. 2.

The process cartridge A includes the image bearing member 1, charging means 8*a*, developing apparatus 7 and cleaning means 9. The photosensitive drum 1 as the image bearing member having a photosensitive layer is rotatingly driven by a motor provided in the main body of the image forming apparatus and a surface of the photosensitive drum is uniformly charged by application of voltage from the charging roller 8 as the charging means. Then, laser beam light corresponding to image information from an optical system 18 is illuminated onto the photosensitive drum 1 through an exposure opening portion, thereby forming an electrostatic latent image on the photosensitive drum 1, and the electrostatic latent image is developed by using toner by means of the developing apparatus 7 to visualize the electrostatic latent image as the toner image. Here, the charging roller 8 is contacted with the photosensitive drum 1 to charge or electrify the photosensitive drum 1.

Further, the developing apparatus 7 serves to supply the toner to a developing area of the photosensitive drum 1 thereby to visualize the latent image as the toner image.

Figure 5:
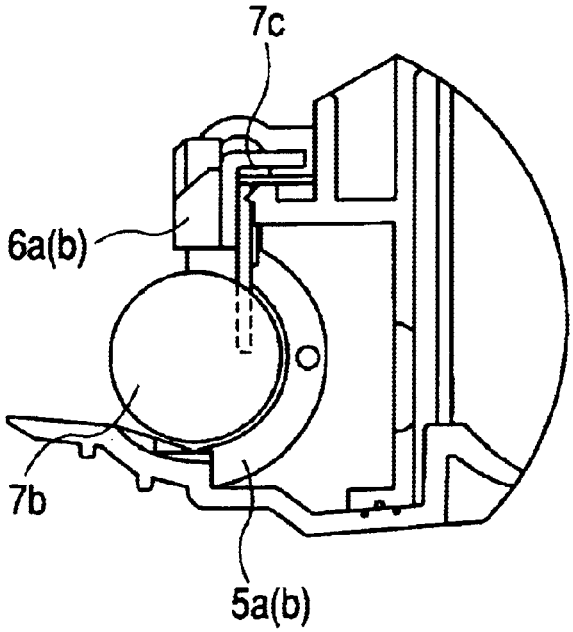
FIG. 5 is a sectional view of a developing apparatus taken along the line 5—5 in FIG. 3.
Figure 6:
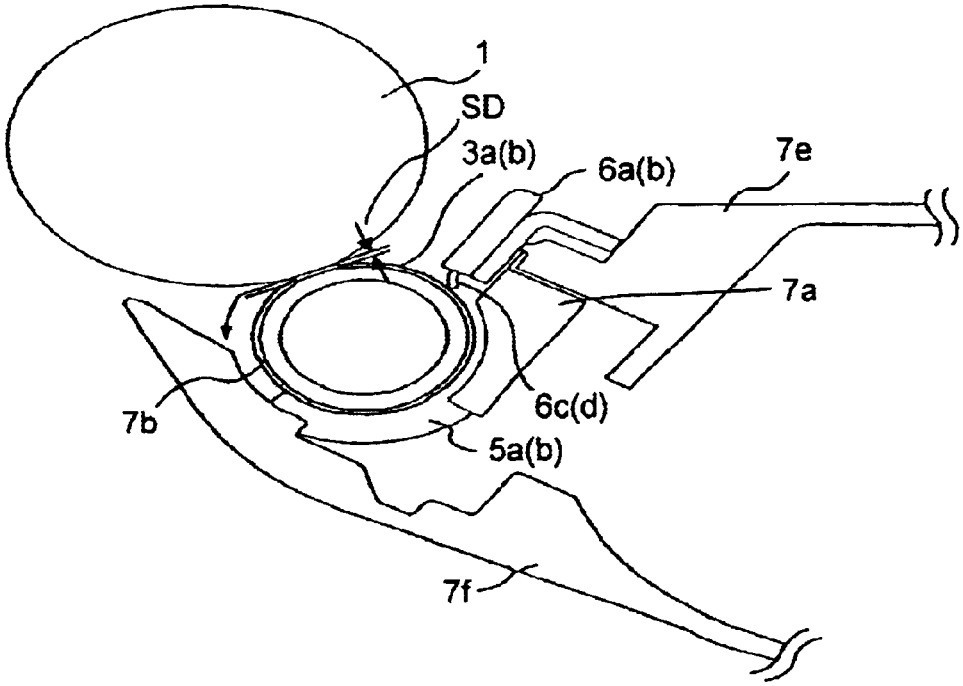
FIG. 6 is a sectional view taken along the line 6—6 in FIG. 3.

With reference to FIGS. 5 and 6, the developing apparatus 7 includes a toner containing portion 7*e*, a developing sleeve (developer bearing member) 7*b* and the like. Within the developing sleeve 7*b*, a magnet 4 is fixedly provided along a longitudinal direction of the developing sleeve and the developing sleeve 7*b* is rotated around the magnet. The toner (magnetic toner) in the toner containing portion 7*e* is supplied to a developing chamber 7*a* by a conveying member, where the toner is adhered to a surface of the developing sleeve by a magnetic force of the magnet 4. Tribo-electric electrifying charges are applied to the toner by a developing blade 7*c*. Thereafter, by the rotation of the developing sleeve, the toner is carried to a developing area opposed to the photosensitive drum 1, where the toner is transferred to the photosensitive drum 1 by developing bias, thereby developing the electrostatic latent image.

By applying voltage having a polarity opposite to a polarity of the toner image to the transferring roller 14, the toner image formed on the photosensitive drum 1 is transferred onto the recording medium 11. Incidentally, after the toner image was transferred, transferring residual toner remaining on the photosensitive drum 1 is removed by the cleaning means 9 and the removed toner is collected into a waste toner reservoir 9*a*.

Various parts such as the photosensitive drum 1 and the like are accommodated in a cartridge frame constituted by joining a toner developing frame 7*d* and a toner containing frame 7*f* and a cleaning frame 2 to form a unit as the process cartridge A. That is to say, the toner developing frame 7*d* and the toner containing frame 7*f* are fused together to form the toner containing portion 7*e* and the developing chamber 7*a*, and the developing sleeve 7*b* and the developing blade 7*c* are attached to the developing chamber to constitute the developing apparatus. The process cartridge A is constituted by rockably connecting the toner developing frame 7*d* to the cleaning frame 2.

(Developing Apparatus)

Next, the developing apparatus according to the present invention will be explained with reference to FIGS. 3 and 5.

Figure 3:
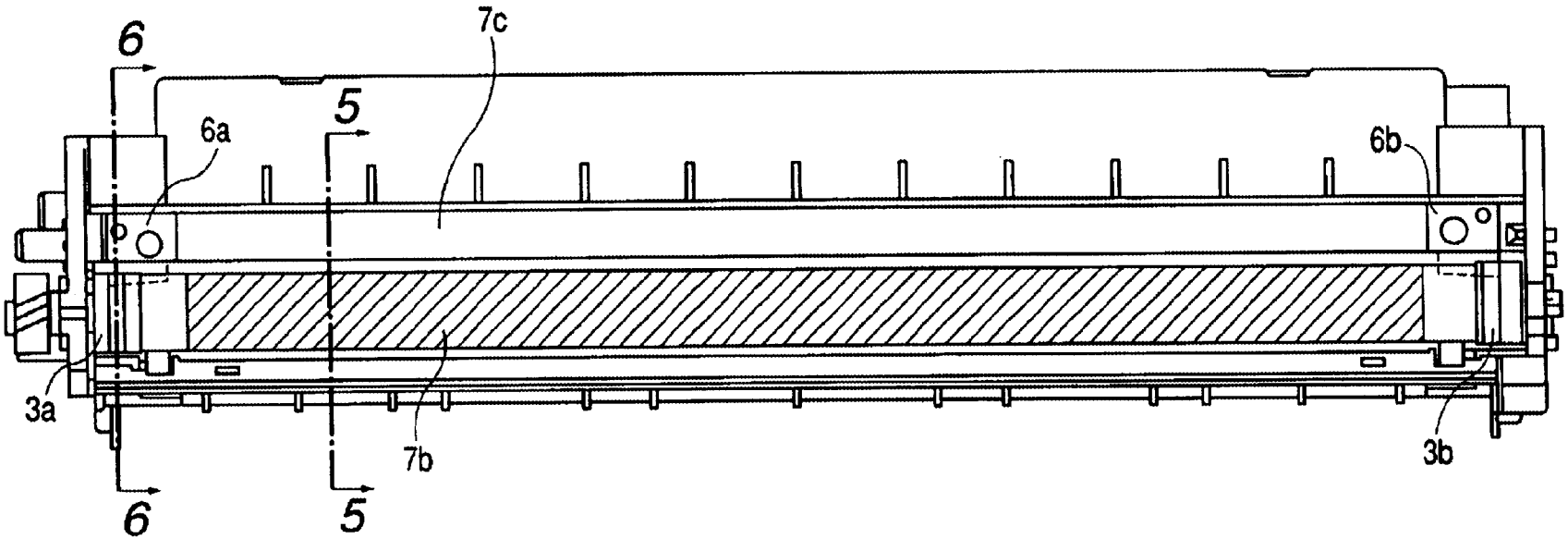
FIG. 3 is a schematic view when a developing apparatus according to a first embodiment is looked at from a photosensitive member side.

FIG. 3 is an appearance view of the developing apparatus 7 looked at from a side of the photosensitive drum 1 and FIG. 5 is an enlarged view of the developing chamber of the developing apparatus and therearound. As shown in FIG. 3, spacer rollers 3*a* and 3*b* for maintaining a constant gap SD (See FIG. 6) between the photosensitive drum 1 and the developing sleeve 7*b* are rotatably mounted on longitudinal end portions of the developer bearing member 7*b*. The developing blade 7*c* abuts against the developing sleeve 7*b* along a longitudinal direction of the developing sleeve to regulate the toner to a predetermined thickness and to apply tribo-electricity to the toner. Further, in the vicinity of the longitudinal end portions of the developing sleeve 7*b*, along a circumferential direction of the developing sleeve, there are provided magnetic seals 5*a* and 5*b* which are spaced apart from an outer circumferential surface of the developing sleeve 7*b* by a predetermined distance or gap, so that the toner is held by magnetic forces of the magnetic seals to prevent the toner from leaking outside. Further, scrapers 6*a* and 6*b* are provided in such a manner that the scrapers are overlapped with the magnetic seals in the longitudinal direction of the developing sleeve and the scrapers extend outside the magnetic seals 5*a* and 5*b* and inside the spacer rollers 3*a* and 3*b* in the longitudinal direction of the developing sleeve.

The scrapers 6*a* and 6*b* are made of resin and are provided at positions where they are overlapped with the magnetic seals 5*a* and 5*b* in the longitudinal direction of the developing sleeve and are positioned in the vicinity of downstream end portions of the magnetic seals in a rotational direction of the developing sleeve. The toner held between the developing sleeve 7*b* and the magnetic seals 5*a*, 5*b* is removed from the surface of the developing sleeve 7*b* by the scrapers 6*a* and 6*b* before the toner reaches the developing portion between the developing sleeve and the photosensitive drum 1 by the rotation of the developing sleeve 7*b*. Each of contact portions between the scrapers 6*a*, 6*b* and the developing sleeve 7*b* has a shape in which the scraper is contacted with a more downstream side in the rotational direction of the developing sleeve 7*b* as the scraper advances toward an image area side (inside) in the longitudinal direction of the developing sleeve (i.e. a shape in which the removed toner is directed toward the image area side (inside) in the longitudinal direction of the developing sleeve by the rotation of the developing sleeve 7*b*). Namely, a leading or tip end of each scraper is cut obliquely. Incidentally, the spacer rollers 3*a* and 3*b* are disposed outside the magnetic seals 5*a* and 5*b* in the longitudinal direction of the developing sleeve. With this arrangement, adhesion of the toner to the spacer rollers 3*a* and 3*b* is suppressed.

(Scrapers According to a First Embodiment)

Now, the scrapers according to a first embodiment of the present invention will be explained.

Figure 4A:
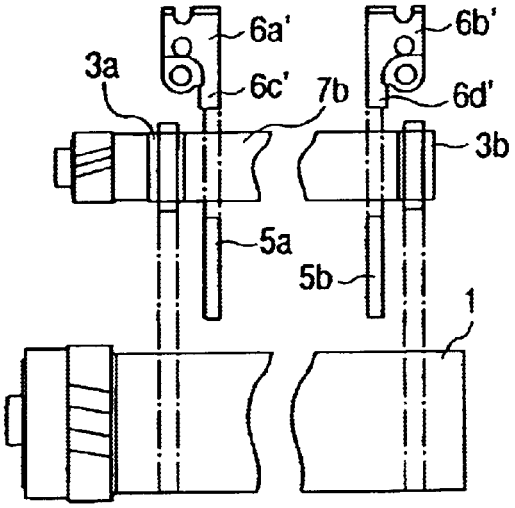
FIG. 4A PRIOR ART
FIG. 4A is a view showing a positional relationship between magnetic seals, scrapers and spacer rollers in the prior art.
Figure 4B:
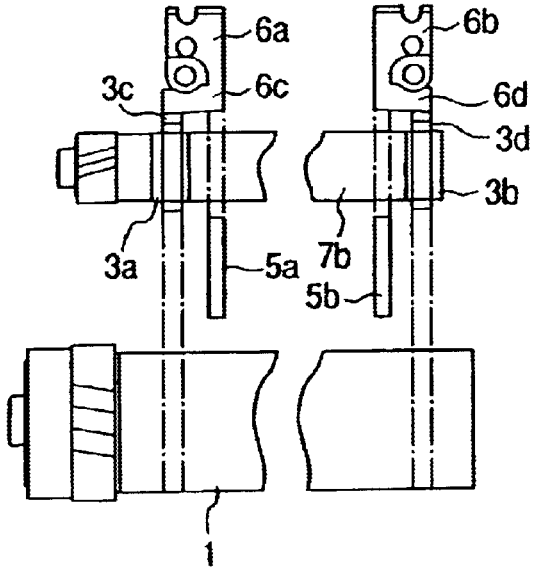
FIG. 4B is a view showing a positional relationship between magnetic seals, scrapers and spacer rollers in the first embodiment.

First of all, a positional relationship between the scrapers, magnetic seals and the spacer rollers in the longitudinal direction of the developing sleeve will be explained with reference to FIGS. 4A to 4C. As shown in FIG. 4A, contact portions 6*c*' and 6*d*' of conventional scrapers 6*a*', 6*b*' to the developing sleeve are merely overlapped with the magnetic seals 5*a* and 5*b*. To the contrary, as shown in FIG. 4B, contact portions 6*c* and 6*d* of scrapers 6*a* and 6*b* according to the first embodiment to the developing sleeve are overlapped with the magnetic seals 5*a* and 5*b* and extend in non-image areas to be contacted with abutment portions 3*c* and 3*d* of the spacer rollers 3*a* and 3*b* to the photosensitive drum 1. Here, although it is desirable that the contact portions 6*c* and 6*d* of the scrapers 6*a* and 6*b* to the developing sleeve are contacted with the whole areas of the abutment portions (3*c* and 3*d*) of the spacer rollers 6*a* and 6*b* to the photosensitive drum 1 as shown in FIG. 4B, such contact portions may be provided to be further contacted with portions where the toner is apt to be scattered. (Among the abutment portions of the spacer rollers to the photosensitive drum, generally, at the image area side (inside of the longitudinal direction of the developing sleeve), the toner is apt to be scattered.) In each of the scrapers according to this embodiment, a leading end thereof is cut obliquely from a magnetic seal corresponding position to a spacer roller corresponding position.

FIG. 6 is a sectional view taken along the line 6—6 and also showing the photosensitive drum 1. The spacer rollers are rotatably attached with respect to the developing sleeve. During development, when the developing sleeve 7*b* is rotated, the spacer rollers 3*a* and 3*b* are rotated to follow the rotation of the photosensitive drum or to follow the rotation of the developing sleeve in dependence upon a force relationship between friction forces f1 acting on the abutment portions between the photosensitive drum and the spacer rollers 3*a* and 3*b*, friction forces f2 acting between inner peripheries of the spacer rollers and an outer periphery of the developing sleeve and friction forces f3 acting on contact portions between the scrapers and the spacer rollers. Namely, as shown in FIG. 6, during the development, the spacer rollers are rotated in a direction while following the rotation of the photosensitive drum 1 or the developing sleeve 7*b* and contact the scrapers before they reach the developing portion between the photosensitive drum 1 and the developing sleeve 7*b*. Thus, if the toner is adhered to the abutment portions of the spacer rollers 6*a* and 6*b* to the photosensitive drum from the ambient atmosphere, before the spacer rollers reach the developing portion between the photosensitive drum 1 and the developing sleeve 7*b*, since the toner is removed by the scrapers 6*a* and 6*b*, the toner does not remain on the abutment portions of the spacer rollers to the photosensitive drum.

Namely, the scrapers according to the present invention have not only the conventional scraper function for removing the toner coming out of the spaces between the magnetic seals and the developing sleeve due to the rotation of the developing sleeve but also a function for removing the toner from the surfaces of the spacer rollers even if the toner scattered from the developing portion or the ambient atmosphere is adhered to the spacer rollers 3*a* and 3*b*. As a result, the distance between the developing sleeve 7*b* and the photosensitive drum 1 can always be held constant, with the result that high quality images can be maintained for a long term.

Further, in the illustrated embodiment, separate members for removing the toner adhered to the spacer rollers 3*a* and 3*b* as disclosed in Japanese Patent Application Laid-open No. 9-325617 are not used, but, since the invention in which the contact portions of the conventional scrapers to the developing sleeve 7*b* are extended in an axial direction of the developing sleeve 7*b* is provided, the manufacturing cost can be suppressed considerably.

(Second Embodiment)

Next, a second embodiment of the present invention will be explained with reference to FIG. 4C.

Figure 4C:
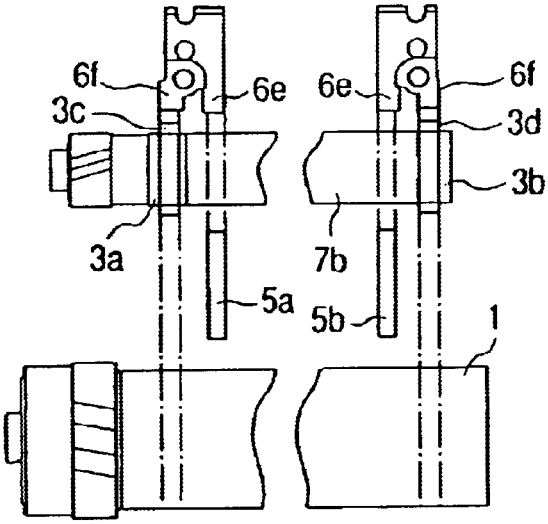
FIG. 4C is a view showing a positional relationship between magnetic seals, scrapers and spacer rollers in an embodiment 2.

In the second embodiment, as shown in FIG. 4C, in addition to conventional scraping or removing portions 6*e*, at least one or more second removing portions 6*f* are provided. The removing portion 6*e* and the second removing portion 6*f* are integrally molded from resin. That is to say, it is designed so that a notch is formed between the removing portion 6*e* and the second removing portion 6*f*.

As shown in FIG. 4C, the second removing portions are disposed nearer the non-image areas than the conventional removing portions 6*e* in the longitudinal direction of the developing sleeve 7*b* and are contacted with the respective abutment portions 3*c* and 3*d* of the spacer rollers 3*a* and 3*b* to the photosensitive drum 1. Here, as shown in FIG. 4C, although it is desirable that the second removing portions 6*f* are contacted with the whole areas of the abutment portions (3*c* and 3*d*) of the spacer rollers 3*a* and 3*b* to the photosensitive drum 1, such removing portions may be provided only at positions where toner is apt to be scattered. (Among the abutment portions of the spacer rollers to the photosensitive drum, generally, at the image area side, the toner is apt to be scattered.) When the developing sleeve 7*b* is rotated during the development, as described in the embodiment 1, the spacer rollers 3*a* and 3*b* are rotated while contacting the second removing portions 6*f* of the scrapers 6*a* and 6*b*.

Thus, even if the scattered toner is adhered onto the spacer rollers 6*a* and 6*b*, the toner is removed by the second removing portions of the scrapers 6*a* and 6*b* promptly, and, therefore, the toner is not remaining on the spacer rollers.

Incidentally, different from the first embodiment, in the second embodiment, since the notch is formed between the removing portion 6*e* and the second removing portion 6*f*, the working for bending the respective removing portions toward any directions can easily performed so that abutment angles of the respective removing portions against the surfaces from which the toner is to be removed can easily be optimized, with the result that the performance for removing the toner from the surfaces from which the toner is to be removed can be enhanced. In the second embodiment, leading ends of the removing portions are cut obliquely with respect to the longitudinal direction of the developing sleeve and leading ends of the second removing portions 6*f* are cut in parallel with the longitudinal direction of the developing sleeve.

As mentioned above, in the scraper according to the present invention, in addition to the conventional scraper function, a function for removing the toner scattered from the developing portion and/or the ambient environment and adhered to the spacer rollers 3*a* and 3*b* can be achieved with low cost. As a result, the distance between the developing sleeve 7*b* and the photosensitive drum 1 can always be held constant, with the result that high quality images can be maintained for a long term.

Further, since the second removing portions (6*f*) are provided independently from the conventional removing portions (6*e*), contact conditions of the respective removing portions to the developing sleeve and contact condition of the respective removing portions to the spacer rollers can be optimized independently.

Further, similar to the first embodiment, separate members for removing the toner adhered to the spacer rollers 3*a* and 3*b* are not used, but, by integrally forming the second removing portions with the conventional scrapers, the manufacturing cost can be suppressed considerably.

As apparent from the above-mentioned explanation, according to the present invention, the high quality images can be obtained stably for a long term.

The present invention is not limited to the above-mentioned embodiments, but various alterations and modifications can be made within the scope of the invention.

What is claimed is:

1. A developing apparatus comprising:

a developer bearing member for bearing developer;

a spacer provided on a surface at an end portion of said developer bearing member in a longitudinal direction of said developer bearing member, for maintaining a constant gap between said developer bearing member and an image bearing member for supplying developer from said developer bearing member;

a seal member for regulating leakage of developer toward the end portion of said developer bearing member along the longitudinal direction; and a developer scraping member provided at a portion overlapping with said seal member in the longitudinal direction of said developer bearing member, contacting said developer bearing member, wherein said developer scraping member contacts a surface of said spacer.

2. A developing apparatus according to claim 1, wherein said developer scraping member contacts a whole abutment area of said spacer to said image bearing member in the longitudinal direction.

3. A developing apparatus according to claim 1, wherein said spacer is provided nearer the longitudinal end portion than said seal member. longitudinal end portion than said seal member.

4. A developing apparatus according to claim 1, wherein said seal member serves to regulate a movement of the developer magnetically and is provided in a non-contact relationship to a surface of said developer bearing member in a circumferential direction of said developer bearing member.

5. A developing apparatus according to claim 1, wherein a notch is provided between a contact portion of said developer scraping member to said developer bearing member and a contact portion of said developer scraping member to said spacer.

6. A developing apparatus according to claim 5, wherein said contact portion of said developer scraping member to said developer bearing member is cut obliquely with respect to the longitudinal direction, and said contact portion to said spacer is cut in parallel with the longitudinal direction.

7. A developing apparatus according to claim 1, wherein said spacer is rotatably attached with respect to said developer bearing member.

8. A developing apparatus according to claim 1, wherein said developing apparatus is mounted to a cartridge detachable to an image forming apparatus.

* * * * *

UNITED STATES PATENT AND TRADEMARK OFFICE

CERTIFICATE OF CORRECTION

PATENT NO. : 6,915,091 B2
DATED : July 5, 2005
INVENTOR(S) : Naoki Matsumaru et al.

It is certified that error appears in the above-identified patent and that said Letters Patent is hereby corrected as shown below:

Column 7,
Line 5, "longitudinal end portion then said" should be deleted; and
Line 6, "seal member." should be deleted.

Signed and Sealed this

Eighteenth Day of October, 2005

JON W. DUDAS
*Director of the United States Patent and Trademark Office*